United States Patent [19]

Bledsoe

[11] 4,359,079

[45] Nov. 16, 1982

[54] WINDOW INSULATION SYSTEM

[76] Inventor: Billy M. Bledsoe, Rte. 2, Fulton Rd., Corryton, Tenn. 37721

[21] Appl. No.: 97,530

[22] Filed: Nov. 26, 1979

[51] Int. Cl.[3] ..... E06B 9/08; E06B 9/20

[52] U.S. Cl. ..... 160/26; 160/39; 160/98; 160/121 R; 160/269

[58] Field of Search ..... 160/21, 26, 31, 39, 160/98, 107, 120, 121 R, 269, 291, 299

[56] References Cited

U.S. PATENT DOCUMENTS

| | | | |
|---|---|---|---|
| 2,054,003 | 9/1936 | Rissmann | 160/31 |
| 2,314,784 | 3/1943 | Helgoth | 160/269 X |
| 2,324,423 | 7/1943 | Pidgeon | 160/31 X |
| 3,292,685 | 12/1966 | Clark | 160/26 |
| 3,372,728 | 3/1968 | Schaefer | 160/39 |
| 3,842,890 | 10/1974 | Kramer | 160/26 |
| 4,151,871 | 5/1979 | Ryan | 160/120 X |
| 4,187,896 | 2/1980 | Shore | 160/121 |
| 4,194,550 | 3/1980 | Hopper | 160/107 X |
| 4,197,896 | 4/1980 | Reichstadt | 160/26 X |
| 4,220,189 | 9/1980 | Marquez | 160/269 X |

FOREIGN PATENT DOCUMENTS

| | | | |
|---|---|---|---|
| 155034 | 4/1953 | Australia | 160/26 |
| 2608728 | 9/1976 | Fed. Rep. of Germany | 160/107 |
| 2619193 | 10/1977 | Fed. Rep. of Germany | 160/26 |
| 2650316 | 5/1978 | Fed. Rep. of Germany | 160/269 |

*Primary Examiner*—Rodney H. Bonck
*Attorney, Agent, or Firm*—Pitts & Kesterson

[57] ABSTRACT

An improved window insulation system is provided which serves to establish a static air panel between the shade and the window pane. The system includes a valance which supports the spring biased shade rod about which the shade is rolled. The valance has a pivoted portion which can be moved away from the shade to facilitate its rolling and to reduce wear on the shade during the rolling operation. When the pivotal portion of the shade is secured in position, it establishes the position of the upper portion of the shade while securing means seal the upright and lower marginal edges of the shade to define the static air panel. To facilitate the rolling operation of the insulated shade, the shade, in one embodiment, includes a plurality of cross seams spaced by preselected distances to increase the shades flexibility.

5 Claims, 11 Drawing Figures

WINDOW INSULATION SYSTEM

This invention relates to a window insulation system for establishing a static air panel between the shade and the window pane to enhance its effective insulation. A shade is provided which is designed to have increased flexibility while incorporating a sheet of insulation material.

It is common knowledge that the windows of a commercial or residential building are a source of energy loss. A number of prior art patents disclose systems which are designed to reduce the energy lost through a window. For example, see U.S. Pat. Nos. 285,006; 710,515; 938,148; 1,508,759; 1,577,574; 1,927,272; 2,313,659; 2,314,784; and 2,548,041. Each of these patents disclose a type of window shade or appliance for increasing the insulation of the window. However, the known prior art devices suffer various disadvantages. For example, certain of the devices are expensive to manufacture and require modifications of the window support structure. Other devices are designed to fit only particular types of windows and are not suitable for including a shade which has a high insulation factor, particularly since such a shade may be difficult to roll and may not be compressible into a small space or valance when rolled.

Accordingly, it is an object of this invention to provide an improved window insulation system. A further object of the invention is to provide an insulation shade which is flexible to facilitate rolling the shade on its rod. A still further object of the invention is to provide a window insulation system which includes a valance having a pivotal portion which can readily be opened for rolling the shade and closed for containing and/or securing the drawn shade in a preselected position. Yet another object of the invention is to provide a window insulation system which is inexpensive to manufacture and easy to install.

Other objects and advantages of the invention will become apparent upon reading the detailed disclosure together with the drawings in which.

In accordance with various features of the invention a window insulation system is provided which facilitates rolling the shade and serves to establish a static air panel between the shade and the window pane to enhance the effective insulation of the system. The system includes a valance which supports a rod about which the shade is rolled. A pivotal portion of the valance can be moved away from the shade to facilitate its rolling and to reduce wear. When the pivotal portion is secured in position, it establishes the position of the upper portion of the shade and forms a seal therewith. Securing means mounted on the upright members of the window pane supporting structure position and seal the opposite marginal edges of the shade to define a static panel of air between the shade and the window pane. The window shade is designed to have a preselected insulation effect and includes cross seams in one embodiment for increasing the flexibility of the shade to facilitate the rolling operation.

Figure 1:
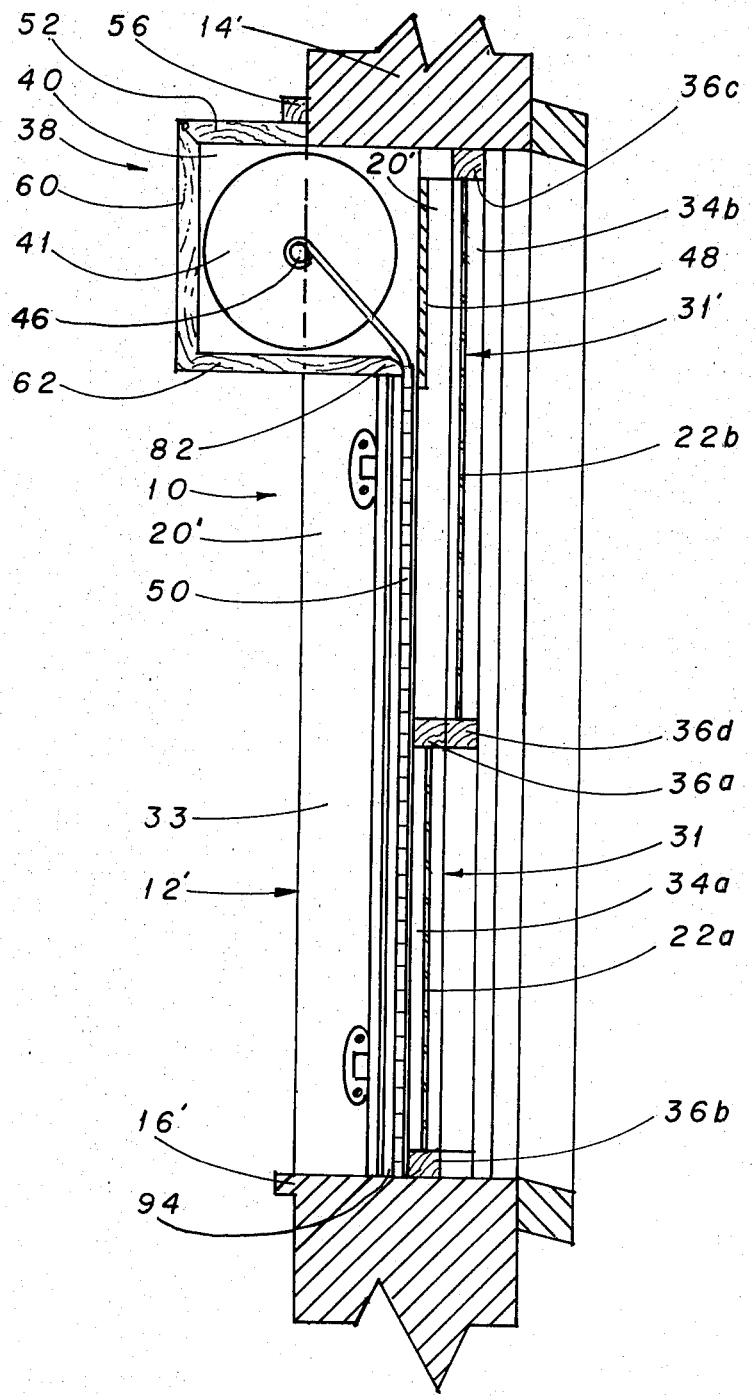
FIG. 1 is a sectional side elevation view of window insulation system installed in the window pane support structure and constructed in accordance with various features of the invention.
Figure 2:
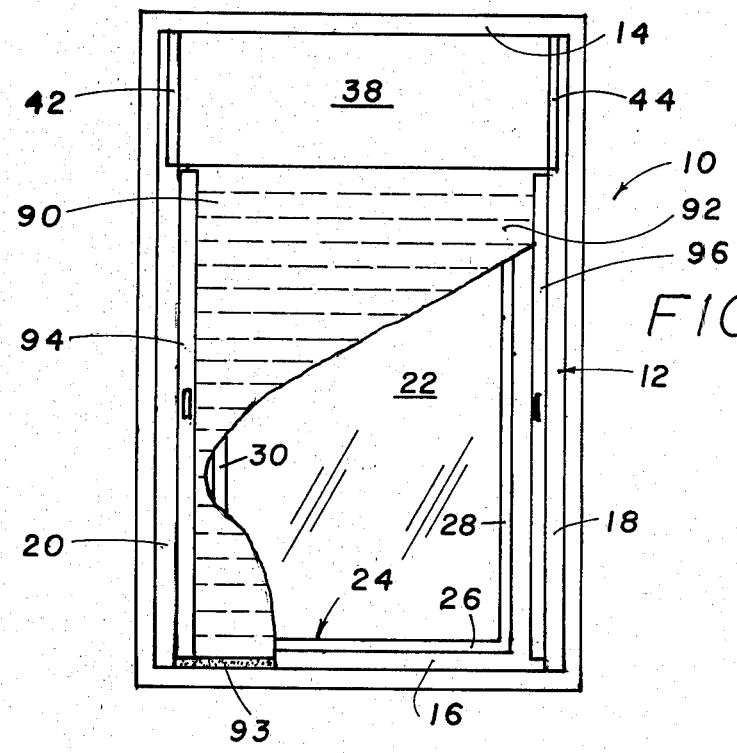
FIG. 2 is a front elevation view of the insulation shade system of FIG. 1 with a portion of the shade broken away.
Figure 3:
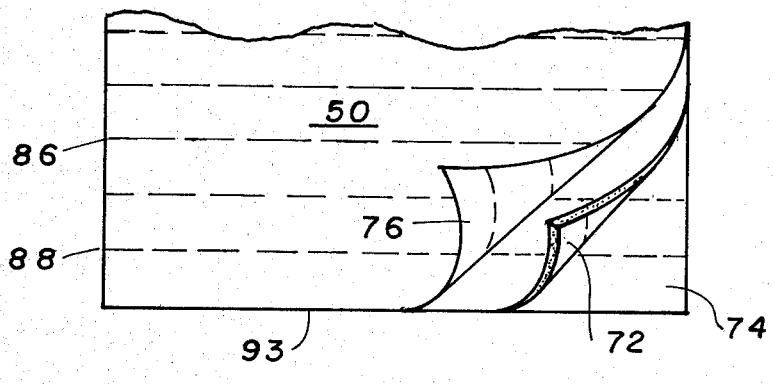
FIG. 3 illustrates the shade shown in FIGS. 1 and 2 with one corner of the shade seperated to depict the shade components.

Referring now to the drawings, a window insulation system constructed in accordance with various features of the invention is generally indicated at 10 in FIGS. 1 and 2. The illustrated system is suitable for being mounted on or proximate any conventional residential or commercial window pane supporting structure, i.e. the window frame, the sash and/or the surrounding wall. For purposes of illustration, the system is mounted on a window frame 12 in FIG. 2 includes an upper cross member 14, a lower cross member 16 and a pair of upright members 18 and 20 which are joined at their opposite ends with the opposite ends of the cross members 14 and 16.

In the window illustrated in FIG. 2, the window pane 22 is not adapted for vertical sliding movement, but is instead rigidly secured in the further frame generally indicated at 24 which receives and supports the marginal edges or perimeter of the pane. This frame 24 often referred to as a sash comprises part of the pane supporting structure and includes an upper cross member (not shown), a lower cross member 26 and a pair of upright frame members 28 and 30 which are joined at their opposite ends with the opposite ends of the upper and lower cross members of the sash or frame.

For purposes of this disclosure, the term window pane supporting structure refers to the frame within which the window pane is mounted, and which is normally bounded on its outermost perimeter by a wall or adjacent window frame. It is recognized that in certain window constructions, particularly in commercial buildings, there is a single stationary window frame which receives the marginal edges of the pane along its internal or innermost perimeter and which is bounded by a wall, ceiling, floor or adjacent frame along its outermost perimeter. In certain other applications, the pane is mounted in a first window frame or sash 31 (See FIG. 1) which is slidably mounted in the stationary window frame 33. As shown in FIG. 1, the slidable sash or frame 31 includes a pair of upright members **34*a* which are interconnected at their opposite ends to the upper and lower cross members 36*a*–*b* thereby defining a rectangular frame for supporting the pane 22*a*. Similarly, a slidable sash or frame 31' supports the upper pane 22*b* and includes a pair of upright members 34*b*** which are interconnected at their opposite ends to the upper and lower cross members 36c and 36d. The upright members of the frames 31 and 31' are mounted in suitable guides in the upright window frame members 20' of the window frame 12' which is bounded along its outermost perimeter by the wall or an adjacent frame structure. As shown in FIG. 1, this frame 12' includes an upper cross member 14' and a lower cross member or window seal 16'.

The guides in the upright window frame members 33 shown in FIG. 1 are offset from each other as illustrated such that the panes 22a and 22b can slide past each other for purposes of opening and closing the window.

Figure 9:
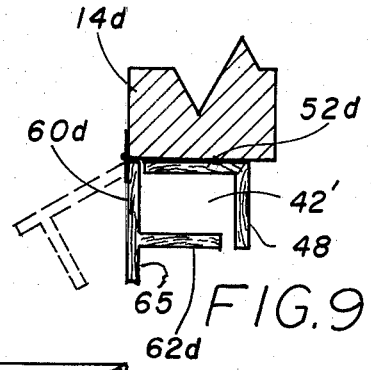
FIG. 9 is a sectional side elevation view of the embodiment shown in FIG. 6.

The window insulation system of the present invention includes a valance 38 which is substantially rectangular in outline and defines a cavity 40 which is proportional for receiving the rolled up shade 41 illustrated diagrammatically in FIG. 1. This valance 38 (See FIG. 2) includes a valance box having end panels 42 and 44 which are fixedly secured to the upper portion of the window support structure which can include a portion of the bounding wall. These upright panels extend outwardly from their supporting structure, in one embodiment, and serve to support the opposite end portions of the shade rod 46 which carries the shade 50. As shown in the embodiment of the valance box illustrated in FIG. 6, the opposite ends of the valance are closed by the upright frame members. Alternatively, the valance box opposite ends can be closed by the end panels 42' as shown in FIG. 9.

The upper portion of the valance box in the embodiment illustrated in FIG. 1 is closed by a first valance cross panel 52 which is supportably joined with the member 14' which in the illustrated embodiment comprises the window frame cross member. A brace 56 assists in fixedly securing the valance to the window pane supporting structure such as the window frame, and enables the valance box to withstand the forces necessary to open and close the valance, as will be described hereinafter, without prying the valance from the frame.

The valance includes a pivotal portion having an upper cross panel 60 hingedly connected to the cross panel 52 of the valance box and a lower cross panel or flange 62. This lower flange 62 and the upper cross panel are connected along abutting edges such that the pivotal portion is substantially L-shaped in cross sectional outline. As shown in FIG. 1 the width of flange 62 is greater than the width of panel 52 such that the leading edge 82 of member 62 serves to position the upper portion of the drawn shade at a preselected location and forms a seal therewith.

As shown in FIGS. 1 and 2, the pivotal portion of the valance has a length which is proportional for being snuggly and sealably received between the upright panels 42 and 44. When the valance is closed, the static air cavity 40 is defined by the valance panels and the seal formed between the leading edge 82 and the shade. As necessary or desired means can be provided for sealing the valance box and the pivotal portion of the valance when it is closed.

Figure 6:
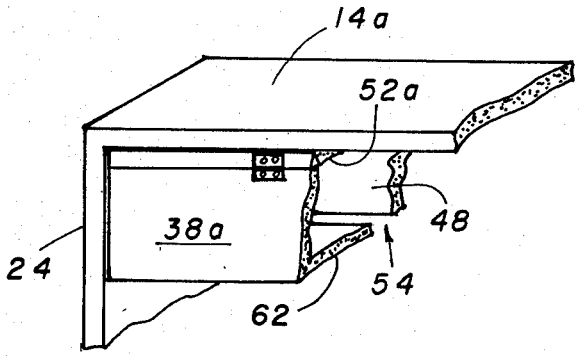
FIG. 6 is a perspective view of a portion of a further embodiment of the invention.

As shown in FIG. 1, a back panel 48 can be provided for sealably engaging the shade. This panel 48 can be a separate unit from the valance box as shown in FIG. 1 or can be an integral part of the valance box as shown in FIGS. 6 and 9. It will be noted that the back panel 48 and the leading edge 82 of the flange 62 form a slot 54 (See FIG. 6) which is of a preselected width such that the upper portion of the shade is trapped and sealed therebetween upon movement of the pivotal portion of the shade to its closed position.

Means are provided to secure the pivotal portion of the valance to the valance box, upon closure of the valance such that the seal maintained by the valance will remain intact. To this end, a spring biased ball 70 can be mounted on the hinged portion of the valance such that it is received within a suitable receptable within one of the upright panels upon closure of the valance box. In the shade embodiment shown in FIG. 7, in which the opposite ends of the valance are closed by the upright frame members, the receptacle can be mounted on the frame of the window or another support structure.

The insulated shade 50 is fabricated from a suitable flexible material having a preselected insulation or "R" factor. It will be recognized that a number of suitable materials can serve as a shade. The illustrated shade 50 includes a sheet of insulation material 72 sandwiched between two thin sheets of flexible backing such as Mylar. Preferrably sheet 74 which will be exposed to the sun when the shade is drawn, is fabricated from a fade retarding material. The sheet 76, which will be exposed to the internal portion of the dwelling can include a suitable decorative surface. The insulation material sheet 72 can be fabricated from a suitable flexible and insulating material which will readily roll up. Certain insulation sheets are semi-rigid, however, and it has been found that cross seams assist in enhancing the flexibility of the shade to facilitate rolling the shade up. In the embodiment shown in FIG. 4, the length of the insulation sheet is less than the length of the sandwiching sheets such that section or tab 80 of the shade does not include any insulating material other than the front and back sheets 74 and 76. The upper edge of the insulation material sheet is spaced a preselected distance from the edge of the shade secured to the shade rod, such that the leading edge 82 of the pivotal portion cross panel 62 engages the shade proximate the location of the edge of the insulation material sheet upon closure of the valance. In this connection, substantially all of the insulation properties of the system can be maintained while the effective diameter of the rolled up shade can be reduced. Moreover, since less insulation material will be wrapped about the conventional spring biased shade rod, the strength of the rod spring can be less and the shade can be more readily rolled up into a smaller space or cavity.

To assist in reducing the wear of the shade during the rolling operation, the leading edge 82 of the pivotal portion is preferably rounded. This rounded edge is less likely to cut the sheet 76 of the shade which is exposed to the internal portion of the dwelling when the shade is drawn.

Figure 4:
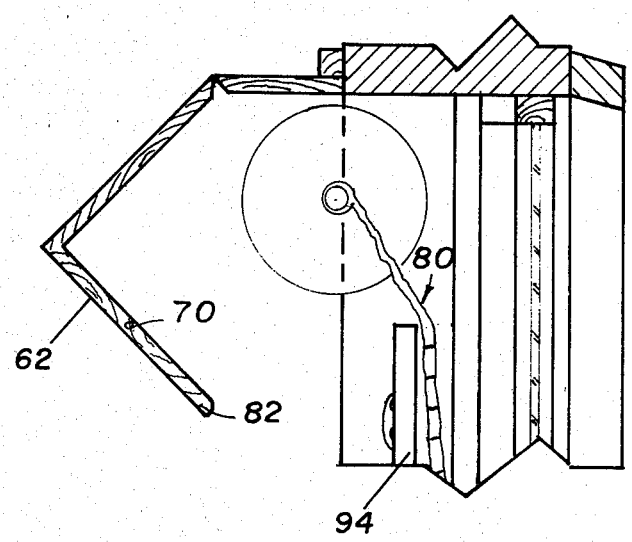
FIG. 4 illustrates the valance of FIG. 1 with the pivotal hinged portion moved to its open position to facilitate rolling the shade.

It is important in practical applications to provide a system in which the shade can readily be rolled up, particularly since an insulated shade is less flexible and more bulky than the normal window shade and therefore more difficult to roll up. In this connection, the pivotal portion can be moved away from the shade to its open position as shown in FIG. 4 during the rolling operation such that the leading edge 82 of the panel 62 does not cause a frictional drag on the shade. Moreover, it has been found that the shade can be made more flexible by cross stitching it with substantially parallel seams which run across the width of the shade and which are spaced between $\frac{3}{4}''$ and 2" apart. For example, the seams 86 and 88 are spaced 1½" along the length of the shade. These seams facilitate rolling the shade with the insulation material therein without significantly attenuating its insulation properties. Further, it has been found that seams having 5–9 stitches per inch are particularly satisfactory for Mylar or other suitable backing since the tendency of the material to tear is reduced.

In order to enhance the effective insulation of the system 10, it is important that a static air panel be trapped between the window pane and the shade. This air panel provides insulation which complements the insulation of the shade itself. To this end, the valance serves to seal the upper portion of the window such that there is a static air pocket within the cavity 41 defined by the valance. The leading edge 82 of the pivotal portion of the valance engages the upper portion of a drawn shade and forms a seal along its line of contact when the valance is closed as shown in FIG. 1. This leading edge 82 establishes the vertical plane within which the drawn shade lies. In the embodiments illustrated in FIGS. 1, 6 and 9 the back panel 48 serves to form the seal with the shade as it is sandwiched between and sealed by the back panel and the leading edge 82. In order to complete the establishment of a static air panel between the pane and the shade it is important that the upright marginal edges 90 and 92 of the shade, together with the lower marginal edge 93 be secured into position and form a seal against or proximate the window pane support structure. To this end, shade edge securing means are provided. The illustrated securing means comprises a pair of substantially similar upright stays or securing members 94 and 96 which are elongated and hingedly connected to respective upright members of the window pane support structure. When open, (See FIG. 4) the securing members 94 and 96 allow the shade to be rolled. When closed, (See FIG. 1) the securing members engage a juxtaposed marginal edge, respectively, of the shade which overlaps a portion of the proximate upright window pane support. The securing members 94 and 96 in one embodiment are spring biased towards a closed position such that when closed, the marginal edges of the shade will be sealed and secured against the upright window pane supports. It has also been found that placing the securing means hinges under tension, serves to provide adequate force for sealing and securing the upright marginal edges of the shade.

It will be recognized that various means can be used for securing the lower edge of the shade to complete the seal and establish a static air panel. In the preferred embodiment the securing means upright members or stays terminate at their lower end portions at a preselected spaced location from the lower cross member of the pane support structure (See FIG. 2). By pulling the lower edge 93 of the shade outwardly and closing the upright securing members, an adequate seal is made at the lower edge of the shade to establish the static air panel. FIG. 2 shows the lower marginal edge of the shade forced against a cross member **36*b*** of the window support structure to form the seal.

Figure 5:
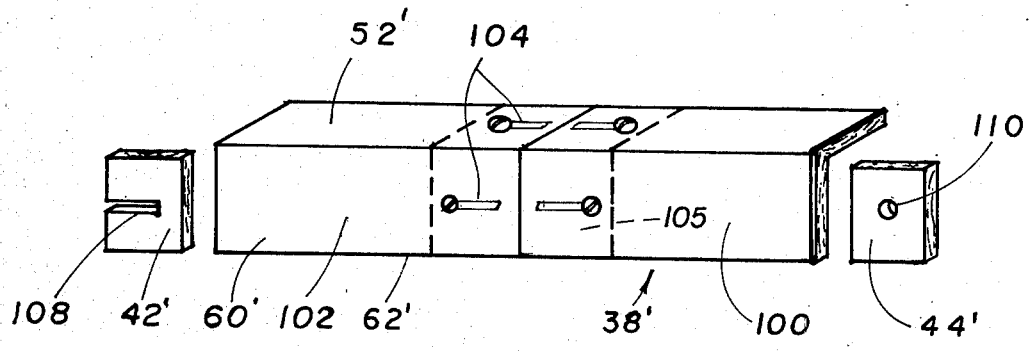
FIG. 5 is an alternative embodiment of the valance shown in FIG. 1 which is adjustable for mounting on windows of various lengths.

FIG. 5 illustrates an alternate embodiment of the valance which is can be adjusted along its length to fit various size windows. More specifically, the extendable valance 38' comprises two portions 100 and 102, each having panels 52', 60' and 62' as described hereinabove. The abutting valance portions 100 and 102 are joined by the U-shaped bracket 105 with suitable slots 104 and slip screws. It will be recognized that single plates with suitable slots can be used. The upright panels 42' and 44' are provided with a shade rod spring lock slot 108 and a round shade holder hole 110, respectively, for holding the rod and biasing the shade spring for rolling the shade.

It will be recognized by those skilled in the art that alternate embodiments can be provided which serve to adjust the length of the valance.

FIGS. 6–11 disclose various alternate embodiments of the valance more specifically, the valance **38*a* of FIG. 6 is adapted for being mounted inside the window frame structure or sill. The panel 52*a* is secured to the upper cross member 14*a*. A suitable hinge is provided to join the pivotal portion and the panel 52*a***. The opposite ends of the valance are closed by the upright members of the window frame structure.

Figure 7:
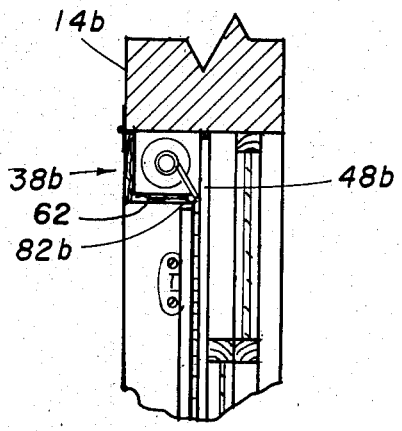
FIG. 7 is a sectional side elevation view of an embodiment of the invention in which the marginal edges of the shade are sandwiched between elongated stops and the securing members.

FIG. 7 discloses a valance having a pivotal portion mounted directly on the upper cross member **14*b* with a hinge which allows the pivotal portion and its flange to be opened and closed. Upon closure, the flange 62 sandwiches and seals the shade between the leading edge 82*b* and the back panel or stop 48*b***.

Figure 8:
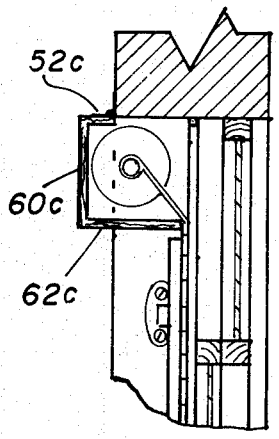
FIG. 8 illustrates a further valance embodiment.

FIG. 8 discloses a valance suitable for being mounted on the header or wall above the window frame structure. Here, the entire box structure is pivoted, that is the panel **52*c*** is hingedly connected with the header or wall surrounding the frame structure.

FIG. 9 discloses a valance embodiment in which the cross panel **60*d* is hingedly connected to the header or wall 14*d* surrounding the window frame support structure. The panel 52*d* is secured directly to the underside of the sill or cross member and the back panel 48 depends from the panel 52*d*. Panel 60*d* overhangs the flange 62*d* and includes a tab 65** which facilitates gripping and rotating the valance box.

Figure 10:
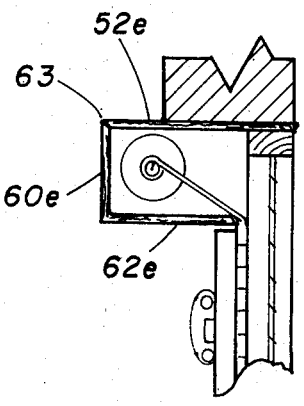
FIG. 10 illustrates an embodiment of the valance box which is mounted partially inside the window.

FIG. 10 discloses a valance embodiment in which panel **52*e* extends partially outside of the window frame. Cross panel 60*e* is hingedly connected to the panel 52*e* at 63**.

Figure 11:
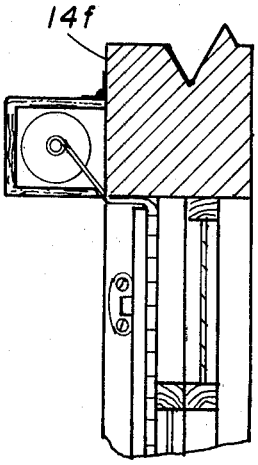
FIG. 11 illustrates an embodiment of the invention which is suitable for being mounted on the header or the wall above the window frame.

FIG. 11 discloses a flush mounting of the valance box on the header or/and wall surrounding the frame support structure. The wall **14*f*** serves as the back panel to form the seal with the shade upon closure of the valance box. The entire valance box is hingedly connected to the header or wall.

From the foregoing description it will be recognized that a shade insulation system is provided which incorporates various advantages over the known prior art. The system is inexpensive to manufacture and can be readily installed by unskilled persons. The system can be manufactured in various sizes and mounted on various sized windows. The system incorporates a valance which can carry a decorative panel which is exposed to the interior of the building. A static air panel is established between the shade and the window pane during closure of the system, to increase its effective insulation. To this end, the upper portion of the shade is sealed by the valance and leading edge of the hinged or pivotal portion. The side and lower margins are secured and sealed by securing means which in the illustrated embodiment comprises a pair of upright securing members which are hingedly mounted on the upright window support structure members. The shade is designed such that it may incorporate a relatively rigid insulation material sheet which can readily be rolled inasmuch as its flexibility is increased by the cross seams.

It is, of course, understood that although a preferred embodiment of the present invention has been illustrated and described, various modifications thereof will become apparent to those skilled in the art, and accordingly, the scope of the present invention should be defined only by the appended claims and equivalents thereof.

I claim:

1. A window insulation system for selectively covering and insulating a window having a window pane, said window having a pane supporting structure including an upper cross member, a lower cross member and a pair of upright members, said pane and pane supporting structure covering the opening in the wall bounding the supporting structure, said window insulation system comprising:

a valance carried by said pane supporting structure and having a pivotal portion which is pivotally mounted with respect to said pane supporting structure;

a shade rod supported at its opposite ends by said pane supporting structure; and an insulated shade mounted on said shade rod, the width of said shade being such that its marginal edges overlap a portion of the upright window pane supporting structure when the shade is drawn, wherein said insulating shade includes an insulating material sheet sandwiched between front and back cover sheets and wherein the insulating material sheet is of a length less than the length of the cover sheets such that one edge of the insulating material is spaced from one edge of said shade secured to said shade rod by a preselected distance to reduce the effective diameter of said shade when rolled upon said shade rod.

2. The window insulation system of claim 1 further comprising:

shade edge securing means for sealing and securing selected marginal edges of the shade proximate the upright members and the lower cross members of the supporting structure; and means for releasably securing the pivotal portion of the valance in its closed position such that the pivotal portion engages the portion of the drawn shade proximate the valance and seals and fixes the position of this portion of the shade to assist in establishing a static air panel between the shade and the window pane when said insulating shade is unrolled from said shade rod.

3. A flexible insulating shade for closing and insulating a window, said window having a pane supporting structure including an upper cross member, a lower cross member and a pair of upright members, said pane and pane supporting structure covering the opening in the wall bounding the supporting structure, said shade being suitable for securing to a rod and rolled up thereon and comprising:

a sheet of insulating material proportional for covering said pane and having upright marginal edges and a lower edge which overlaps a portion of said pane supporting structure;

front and back covering sheets which overlay said insulating material sheet, wherein the length of said covering sheets is greater than the length of said insulating material and wherein said insulating material sheet is secured between said front and back cover sheets at a spaced location from one end of said shade, whereby the end portion of said shade which is devoid of said insulating material is secured to said rod thereby reducing the effective diameter of said shade when rolled upon said rod, and means for securing said front and back covering sheets to said insulating material sheet interposed between said front and back covering sheets, said means for securing said sheets comprising a plurality of spaced apart seams which are substantially parallel and extend horizontally across said shade which is hung upright from one of its end portions, said seams serving to enhance the flexability of said shade to facilitate rolling said shade upon said rod.

4. A window insulating system for selectively covering a paned window in a wall to produce a static air panel adjacent said window, said window having a pane supporting structure including an upper cross member, a lower cross member and a pair of upright members joined to said wall, said window insulating system comprising:

a valance carried by said pane supporting structure adjacent said upper cross member, said valance having at least a pivotal portion provided with a leading edge, a pivot means attached to said pivotal portion whereby said leading edge may be moved from a position proximate said window to a position removed from said window;

a rotatable shade rod mounted at its opposite ends within said valance adjacent said upper cross member;

an insulating shade to be rolled upon or rolled from said shade rod having one end attached to said shade rod, the width of said insulating shade being such that edges of said insulating shade overlap a portion of said upright members when said shade covers said window and the length of said insulating being sufficient to cover said window when rolled from said shade rod; said insulating shade comprising an insulating material sheet sandwiched between front and back cover sheets, said front and back cover sheets being joined by a series of horizontal fastenings producing lines of reduced thickness which are substantially parallel across said shade and serve to enhance the flexibility of said shade such that it may be readily rolled upon said shade roller;

shade edge securing means pivotally mounted on said upright members, said securing means sealing and securing selected marginal edges of said insulating shade proximate said upright members and said lower cross member when pivoted toward said upright members to assist in establishing said static air panel, and said securing means freeing said marginal edges of said insulating shade when pivoted away from said upright members; and means for releasably securing said pivotal portion of said valance in a position such that said leading edge of said lower cross panel engages a portion of said insulating shade proximate said valance for sealing and securing said portion of said insulating shade to further assist in establishing said static air panel.

5. A window insulating system for selectively covering a paned window in a wall to produce a static air panel adjacent said window, said window having a pane supporting structure including an upper cross member, a lower cross member, and a pair of upright members joined to said wall, said window insulating system comprising:

a valance carried by said pane supporting structure adjacent said upper cross member, said valance having at least a pivotal portion provided with a leading edge, and pivot means attached to said pivotal portion whereby said leading edge may be moved from a position proximate said window to a position removed from said window;

a rotatable shade rod mounted at its opposite ends within said valance adjacent said upper cross member;

an insulating shade to be rolled upon or rolled from said shade rod having one end attached to said shade rod, the width of said insulating shade being such that edges of said insulating shade overlap a portion of said upright members when said shade covers said window, and the length of said insulating shade being sufficient to cover said window when unrolled from said shade rod, said insulating shade comprising an insulating material sandwiched between front and back cover sheets with said insulating material sheet being of a length less than the length of said front and back cover sheets such that one end of said insulating material sheet is spaced from said shade rod a preselected distance to reduce the effective diameter of said insulating shade when rolled upon said shade rod;

shade edge securing means pivotally mounted on said upright members, said securing means sealing and securing selected marginal edges of said insulating shade proximate said upright members and said lower cross member when pivoted toward said upright members to assist in establishing said static air panel, and said securing means freeing said marginal edges of said insulating shade when pivoted away from said upright members; and means for releasably securing said pivotal portion of said valance in a position such that said leading edge of said lower cross panel engages a portion of said insulating shade proximate said valance for sealing and securing said portion of said insulating shade to further assist in establishing said static air panel.

* * * * *